US007559795B2

(12) United States Patent
Byrne

(10) Patent No.: US 7,559,795 B2
(45) Date of Patent: Jul. 14, 2009

(54) USB CONNECTION ASSEMBLY

(76) Inventor: Norman R. Byrne, 2736 Honey Creek, NE., Ada, MI (US) 49301

( * ) Notice: Subject to any disclaimer, the term of this patent is extended or adjusted under 35 U.S.C. 154(b) by 0 days.

(21) Appl. No.: 11/760,921

(22) Filed: Jun. 11, 2007

(65) Prior Publication Data

US 2008/0305679 A1 Dec. 11, 2008

(51) Int. Cl.
*H01R 13/60* (2006.01)

(52) U.S. Cl. ..... 439/536

(58) Field of Classification Search ..... 439/885, 439/535, 536, 590, 937
See application file for complete search history.

(56) References Cited

U.S. PATENT DOCUMENTS

| | | | | |
|---|---|---|---|---|
| 4,875,880 | A * | 10/1989 | Welch et al. | 439/536 |
| 5,863,016 | A * | 1/1999 | Makwinski et al. | 248/27.1 |
| 6,554,656 | B2 * | 4/2003 | Hatagishi et al. | 439/752 |
| 7,182,633 | B2 * | 2/2007 | Byrne | 439/536 |

* cited by examiner

*Primary Examiner*—Ross N Gushi
(74) *Attorney, Agent, or Firm*—Varnum, Riddering, Schmidt & Howlett LLP

(57) ABSTRACT

A USB adapter/connector assembly (200) is adapted for use within an adapter kit (100) to accommodate couplers and jacks of various sizes. The adapter/connector assemblies which may be accommodated include not only the USB assembly (200), but other assemblies such as an HDMI adapter/connector assembly (206).

16 Claims, 7 Drawing Sheets

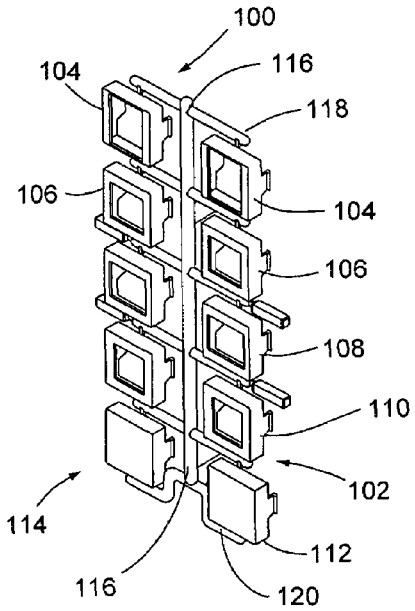
Fig. 1 (Prior Art)
Fig. 2 (Prior Art)
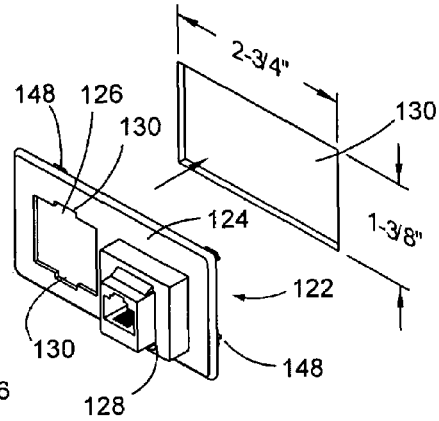
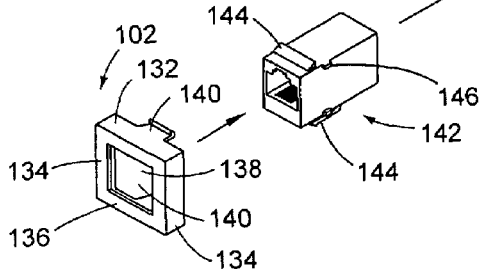
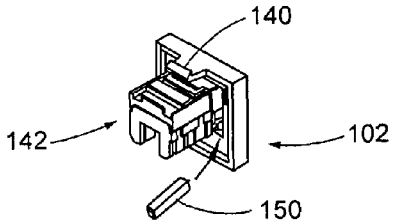
Fig. 3 (Prior Art)
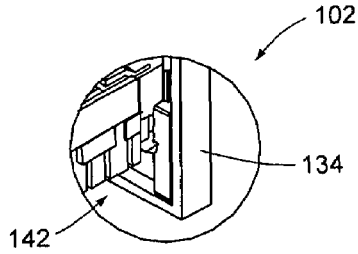
Fig. 4 (Prior Art)

USB CONNECTION ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The invention relates to connectors and couplers for providing voice and data communications and, more particularly, to adapters for providing means for accommodating couplers and jacks developed by various manufactures, to standard plate openings, and including USB and similar connection assemblies.

2. Background Art

Efficient organization of various types of devices requiring electrical power or data communications within an office, commercial, industrial or residential environment has been a historical problem. Such devices often include lamps, typewriters and the like. More recently, this problem has been exacerbated by the proliferation of additional devices for communications, such as complex telephone stations, computers, video displays and the like. One problem associated with the efficient organization in the use of such devices relates to the abundance of wiring arrays and the positioning of the energy requiring devices within the environment, particularly in office environments.

One relatively substantial advance in the art relating to the mounting of electrical receptacles for work surfaces and the like is shown in the commonly owned Byrne, U.S. Pat. No. 4,747,788 issued May 31, 1988. In the Byrne patent, a retractable power center includes a rectangular housing formed in the work surface, with a clamping arrangement to secure the housing to the work surface. A lower extrusion is connected to a lower portion of the housing, and a manually moveable power carriage mounts the receptacles. In response to manual application of upward forces on the power carriage, the carriage may be raised upward into an extended, open position. Small bosses extending from the sides of the carriage, and resting on the top portion of the housing, support the carriage in the extended, open position. In the open position, the user can energize desired electrical devices from the receptacles and then lower the carriage into a releaseably secured, retractable position.

A stationary device having electrical services outlets is shown in commonly owned Byrne, U.S. Pat. No. 6,042,426 issued Mar. 28, 2000. Therein, a multi-user services module includes a housing portion with a hemispherical configuration. The housing portion is integrally molded to a depending cylindrical housing portion. The cylindrical housing portion is fitted into an opening in a conference table or the like. Power receptacles and data receptacles are molded and installed in the hemispherical housing portion.

As earlier mentioned, the proliferation of communications and computer equipment has lead to a substantial amount of use of communications interconnection assemblies. For voice and data communications, the interconnection assemblies are typically referred to as comprising a RS-232 communications coupler and communications jack. For purposes of description, these elements are typically collectively referred to as "coupler/jacks."

In the industry, voice/data coupler/jacks are designed and sold by various manufacturers. These manufacturers include, for example, AT&T (or Lucent Technologies), Panduit, Krone and Ortronics. One problem which exists with respect to the various types of couplers and jacks is that their overall size is not standardized. Accordingly, even if wall or floor plates are utilized which have a standardized opening size, the couplers and jacks of the various manufactures are not standardized in size. Still further, elements associated with wall plates, couplers and jacks and the like are relatively small and sometimes difficult to properly maintain in inventory.

Another substantial advance in the art relating to the use of connectors and couplers for providing voice and data communications is disclosed in the commonly owned Byrne, U.S. Pat. No. 7,182,633 issued Feb. 27, 2007. This Byrne patent is described as prior art in subsequent paragraphs herein, with respect to FIGS. 1-4.

SUMMARY OF THE INVENTION

In accordance with the invention, a voice/data adapter kit is provided, with the kit including the following items: a base plate; a plurality of adapters, with each of said plurality of adapters having openings of various sizes; and a carrying spline, with said plurality of adapters being releaseably secured to said spline.

BRIEF DESCRIPTION OF THE SEVERAL VIEWS OF THE DRAWING

The invention will now be described with reference to the drawings, in which:

FIG. 1 is a prior art perspective view of a voice/data adapter spline, and with the spline releaseably securing a series of adapters thereto;

FIG. 2 is a perspective and exploded view of the assembly of one of the voice/data adapters carried on the spline with a coupler and jack, and base plate mountable into a surface opening;

FIG. 3 is a perspective view of a rear side of one of the adapters, secured to a coupler and jack, and showing the use of a wedge for purposes of securing the same;

FIG. 4 is an enlarged view of the position of the wedge depicted in FIG. 3;

DETAILED DESCRIPTION OF THE INVENTION

Figure 5:
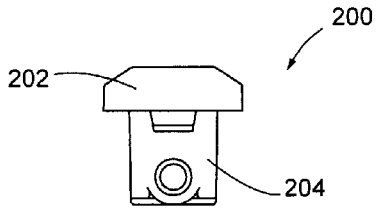
FIG. 5 is an underside view of a USB adapter and connector assembly in accordance with the invention.
Figure 6:
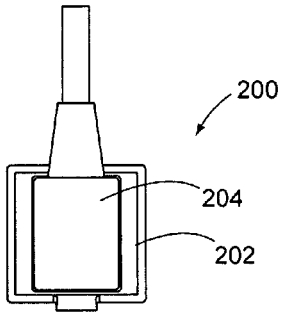
FIG. 6 is an upside down, rear view of the USB assembly shown in FIG. 5.
Figure 7:
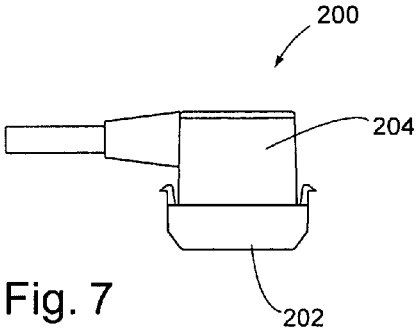
FIG. 7 is a left-end, elevation view of the USB assembly shown in FIG. 5.
Figure 8:
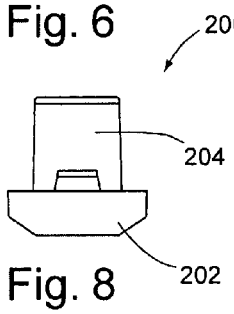
FIG. 8 is a top, plan view of the USB assembly shown in FIG. 5.
Figure 9:
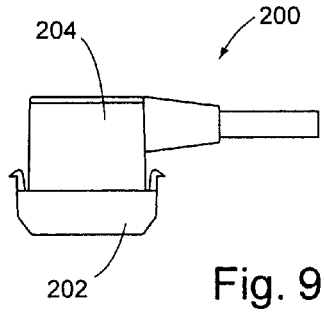
FIG. 9 is a right-end, elevation view of the USB assembly shown in FIG. 5.
Figure 10:
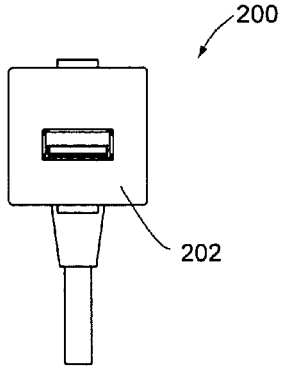
FIG. 10 is a front, elevation view of the adapter and connector shown in FIG. 5.

The principles of the invention are disclosed, by way of example, in a series of adapters and connectors (or jacks), with the adapters being capable of being utilized in a voice/data adapter kit, as illustrated with respect to FIGS. 5-21. For purposes of background, a voice/data adapter kit 100 is first described herein, and illustrated with respect to FIGS. 1-4.

It should be noted that the particular voice/data kit 100 illustrated in FIGS. 1-4 can be characterized as a prior art adapter kit, and is fully disclosed in Byrne, U.S. Pat. No. 7,182,633 issued Feb. 27, 2007. However, this adapter kit 100 will be described in detail in the following paragraphs. Thereafter, the additional types of connector assemblies or couplers and jacks in accordance with the invention which may be utilized with the adapter kit 100 will be described with respect to FIGS. 5-21. The voice/data adapter kit 100 includes a plurality of voice/data adapters, and the base plate. The plurality of voice/data adapters accommodates couplers and jacks developed by various manufacturers and having varying sizes. Further, the voice/data adapter kit 100 includes a carrying spline to which the plurality of adapters are releaseably secured. In this manner, the varying adapters can be conveniently purchased and stored for inventory.

Turning to the drawings, the voice/data adapter kit 100 is depicted in part in FIG. 1. Specifically, the voice/data adapter kit 100 includes a plurality of voice/data adapters 102. In the particular embodiment of a voice/data adapter kit illustrated in FIGS. 1-4, the voice/data adapters 102 include adapters 104, 106, 108, 110 and 112. In the particular embodiment illustrated as voice/data adapter kit 100 there are a pair of each of the adapters 104, 106, 108, 110 and 112. Although shown in this pair relationship, it should be emphasized that any number of voice/data adapters 102 may be incorporated in a voice/data adapter kit. The purpose for the pair relationships is that it is not uncommon for a floor, wall or other surface opening, into which couplers and jacks will be inserted and engaged with other communications cabling, to employ a pair of voice or data communications couplers and jacks.

In this particular configuration of an adapter kit 100, the adapter pair 104 may be constructed so as to accommodate couplers and jacks falling within Categories 6, 5E and 5, and manufactured by Ortronics. Correspondingly, the adapter pair 106 may accommodate couplers and jacks falling within Category 5 and manufactured by AT&T and Lucent Technologies. Correspondingly, adapter pair 108 may comprise adapters accommodating Category 5 couplers and jacks manufactured by Panduit. Still further, adapter pair 110 may accommodate couplers and jacks falling within the scope of Category 5 and manufactured by Krone or Hubbell. In addition, in the particular embodiment of an adapter kit 100 in accordance with the invention, the adapter pair 112 actually comprise "blanks." That is, they would be utilized to cover an opening in a base plate, when no coupler and jack will be utilized for that particular opening. Again, in accordance with the invention, it is advantageous to have these adapter pair blanks 112 conveniently located and available with the other adapter pairs.

As further shown in FIG. 1, the voice/data adapters 102 are each secured to a connector or carrying or connecting spline 114. The purpose of the connecting spline 114 is to releaseably secure the voice/data adapters 102. Specifically, the connecting spline 114 includes a central post 116 having the configuration illustrated in FIG. 1. Connected to or otherwise integral with the central post 116 are a series of cross bars 118. In the particular embodiment illustrated in FIG. 1, there are a series of five identical cross bars 118, having a spaced relationship and a parallel configuration. At the lower part of the central post 116 is an angled cross bar 120. The voice/data adapter pairs 104, 106, 108 and 110 are each connected at their upper portion to a separate one of the cross bars 118. The adapter blanks 112 are releaseably secured to the angled cross bar 120 at the lower portions thereof. The connecting spline 114 is relatively conventional in nature and composition. For example, articles of manufacture similar to the connecting spline 114 have been used in the prior art for purposes of conveniently securing small assembly elements for toys, garden equipment and comparable items where assembly is required. The voice/data adapters 102 are secured to the cross bars 118 and angled cross bar 120 in a manner so that a relatively small amount of manually exerted forces can "break away" the selected voice/data adapter 102 from the connecting spline 114.

Turning to FIG. 2, the voice/data adapter kit 100 also includes a base plate 122. Although various types of base plates may be utilized without departing from the novel concepts of the invention, the particular base plate 122 has a rectangular configuration with a front surface 124. Extending through the front surface 124 are a pair of plate openings 126 and 128. Also shown in FIG. 2 is a wall, floor or other surface opening 130. Although not shown in FIG. 2, the opening 130 may include various communications cables and wires, for voice, data or other computer and communications purposes. The cable or wiring (not shown) would be adapted to communicably connect to the couplers and jacks described in subsequent paragraphs herein.

Turning to the configuration of the base plate 122, each of the openings 126 and 128 is identical to the other opening. The openings 126, 128 each have a substantially square or rectangular configuration, with upper and lower notches 130 positioned therein as illustrated in FIG. 3. As described herein, the base plate 122 is included as part of the voice/data adapter kit 100.

With further reference to FIG. 2, one of the voice/data adapters 102 is illustrated therein, in perspective view. As illustrated in FIG. 2, the particular voice/data adapter 102 may be any of the adapters 104, 106, 108 or 110. The particular adapter 102 illustrated in FIG. 2 has a substantially square or rectangular outer configuration, with a top portion 132, sides 134 and lower portion 136. A variable opening 138 extends through the adapter 102. Extending rearwardly from the top portion 132 is a latch 140 having the particular configuration as illustrated in both FIG. 2 and FIG. 3. A substantially similar latch 140 extends rearwardly from the bottom portion 136 of the adapter 102. The bottom latch 140 can be partially seen in FIG. 2.

The voice/data adapter kit 100 includes the adapters 102, connector spline 114 and the base plate 122. Not included within the kit is a coupler and jack 142, as illustrated in FIG. 2. The coupler and jack 142 is conventional in design and known in the prior art. As previously described herein, the coupler and jack 142 is not only conventional in design but various sizes of couplers and jacks 142 are manufactured by various companies. In accordance with the invention, and for purposes of accommodating the variously sized couplers and jacks 142, the opening 138 of the adapter 102 varies in size. However, further in accordance with the invention, the overall, outer dimensions of the adapter 102 do not vary. That is, outer dimensions of the adapter 102 are standardized so as to appropriately fit into the standardized size of the plate openings 126, 128. In this manner, with the adapter kit including a number of variously sized adapters 102 releaseably secured to the connecting spline 114, a kit can be acquired by the installer, and used to accommodate variously sized coupler and jacks 142 acquired from different manufactures.

With regard to assembly, FIG. 2 illustrates that the coupler/jack 142 includes top and bottom connector ledges 144, and lateral tabs 146.

With the foregoing configuration, and for purposes of assembly, the coupler and jack 142 is first "snap fitted" into the variably sized opening 138 of the adapter 102. When the adapter 102 and the coupler and jack 142 have been snap fitted together, the coupled assembly may then be "snap fitted" into one of the openings 126, 128 of the base plate 122. FIG. 2 illustrates the opening 128 as having an adapter 102 and a coupler and jack 142 already snap fitted into the opening 128. With this assembly, the base plate 122 can then be connected to or otherwise appropriately fitted within the surface opening 130. For example, the base plate 122 may include snaps 148 for this purpose.

The voice/data adapter kit 100 may include other concepts, specifically associated with particular couplers and jacks manufactured by various companies. For example, AT&T and Lucent Technologies manufacture a coupler and jack which is characterized as a "Category 5 rocker type." For purposes of securing these particular couplers and jacks to an adapter 102, a pair of wedges 150 are utilized. As an example, FIG. 3 illustrates a rear perspective view of an adapter 102 snap fitted with one of the AT&T and Lucent Technologies coupler and jack 142. For purposes of appropriately securing this particular coupler and jack 142 to the adapter 102, a pair of wedges 150 may be utilized. FIG. 3 illustrates only one of the wedges 150. The other wedge 150 would be secured on the other side (not shown) of the coupler and jack 142. FIG. 4 illustrates an enlarged view illustrating the location in which one of the wedges 150 would be inserted.

The foregoing has described a voice/data adapter kit 100. It is apparent that various configurations of the voice/data adapter kit 100 may be utilized. For example, different numbers of adapters (both open and blank) may be utilized with an appropriately sized connecting spline. Also, adapters may be included for purposes of accommodating couplers and jacks from a number of other manufacturers. Also, base plates incorporated within the kit 100 may be of various sizes and configurations. The primary importance is that the openings 126, 128 are appropriately standardized to the outer dimensions of the adapters 102. Also, the base plates could utilize any number of openings, and may be sized with any number of outer dimensions.

Figure 11:
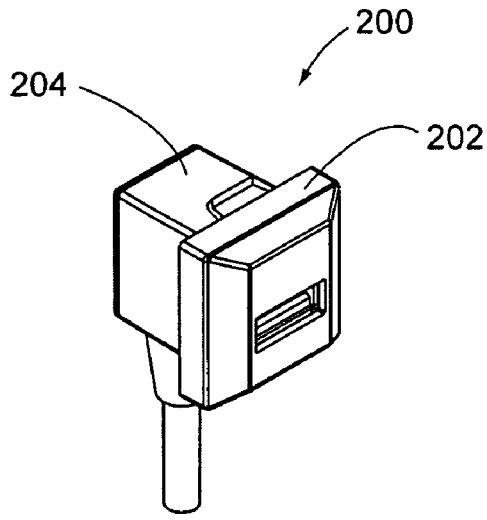
FIG. 11 is a perspective view of the adapter and connector shown in FIG. 5.
Figure 12:
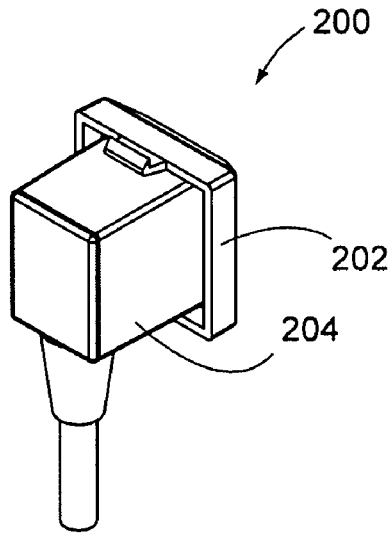
FIG. 12 is a perspective view similar to FIG. 11, but rotated 180 degrees relative to FIG. 11.

The principles of the invention will now be described with respect to the various connector assemblies illustrated in FIGS. 5-21. As illustrated in FIGS. 5-10, the connector assemblies can include a USB adapter/connector assembly 200. The assembly 200 includes a USB adapter 202, and a USB connector 204. Perspective views of the USB assembly 200 are shown in FIGS. 11 and 12.

Figure 13:
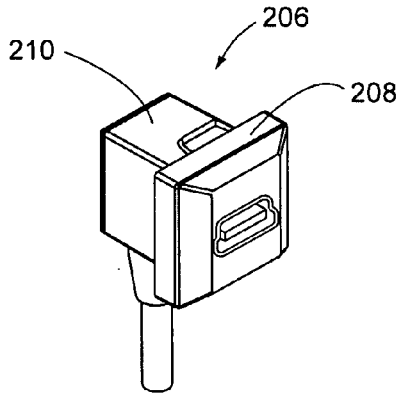
FIG. 13 is a perspective view of an HDMI adapter and connector.
Figure 14:
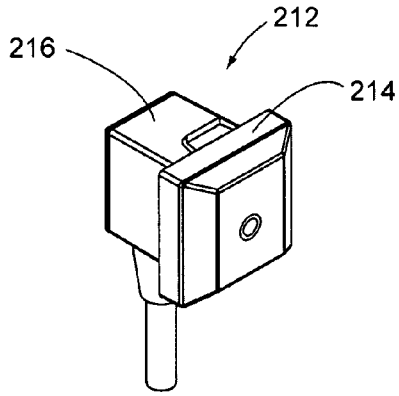
FIG. 14 is a perspective view of a general component-type adapter and connector.

Various other types of adapter/connector assemblies may also be utilized in accordance with the invention. For example, FIG. 13 is a perspective view of an HDMI assembly 206, comprising an HDMI adapter 208 and HDMI connector 210. Correspondingly, FIG. 14 is a perspective view of a "general component-type" assembly 212. The assembly 212 includes a general component adapter 214 and general component connector 216.

Figure 15:
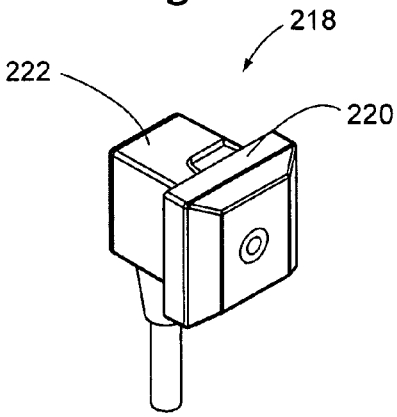
FIG. 15 is a perspective view of a headphone adapter and connector.
Figure 16:
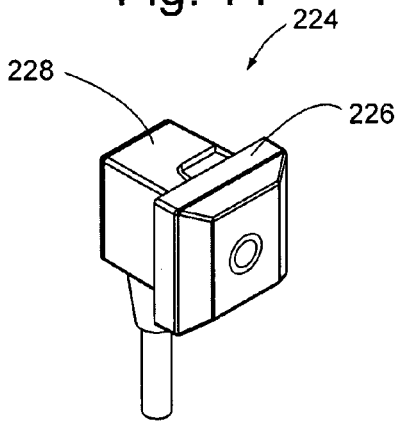
FIG. 16 is a perspective view of an optical video adapter and connector.
Figure 17:
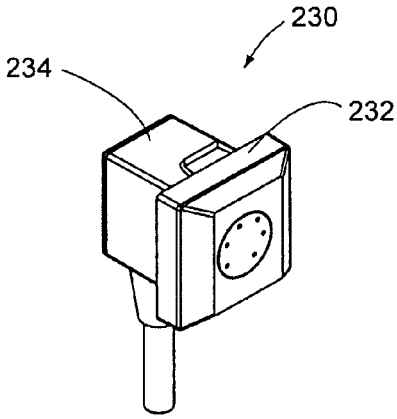
FIG. 17 is a perspective view of a pin connector adapter and jack.
Figure 18:
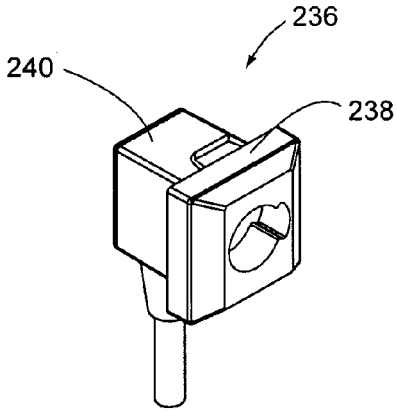
FIG. 18 is a perspective view of an S-video adapter and jack.
Figure 19:
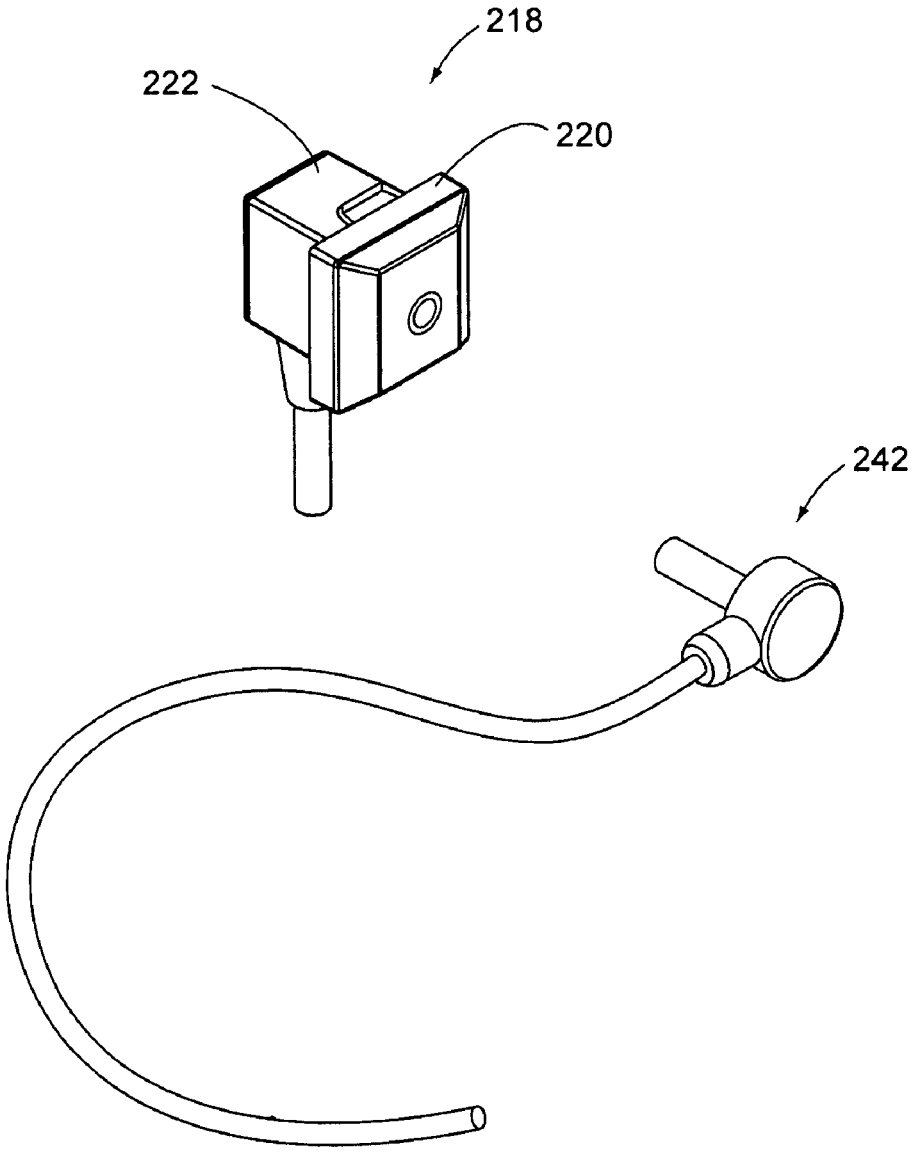
FIG. 19 is a perspective and partially exploded view showing the connection of a headphone plug into the adapter and connector shown in FIG. 15.
Figure 20:
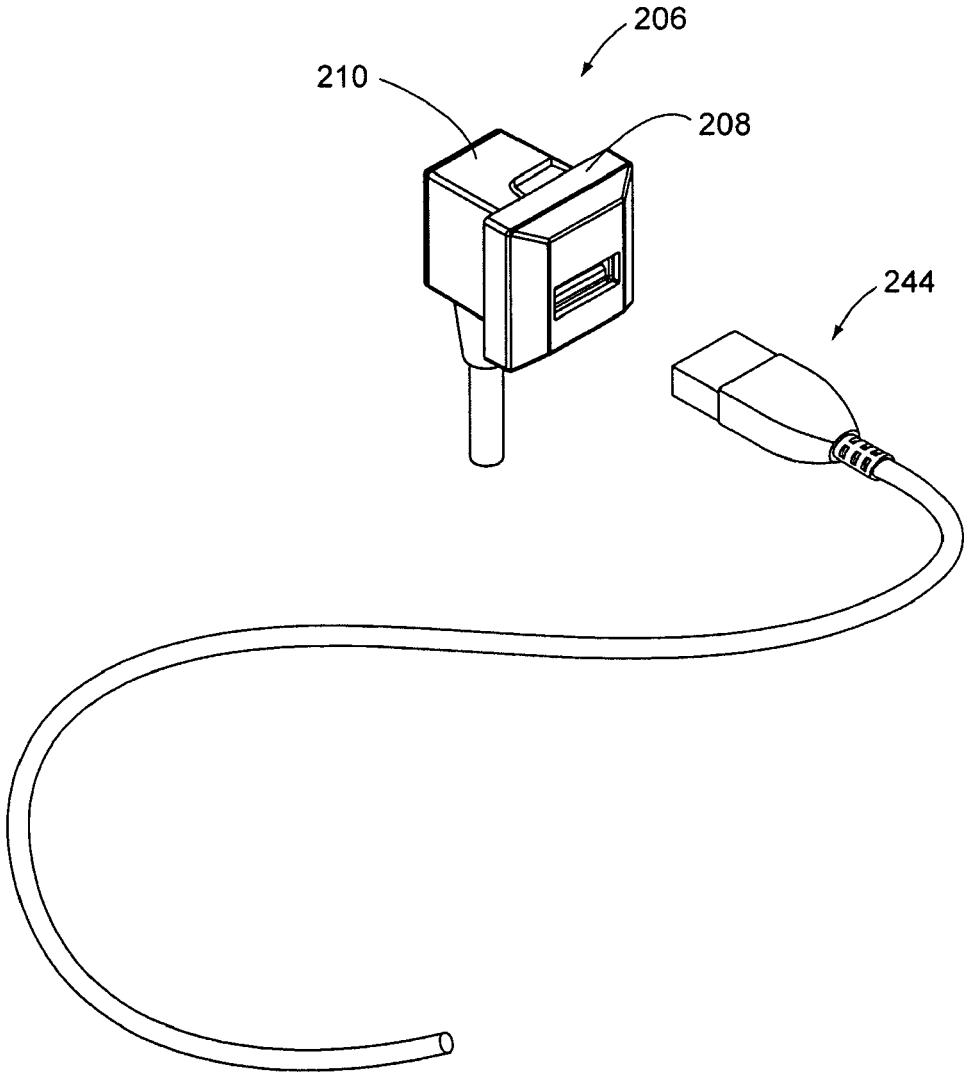
FIG. 20 is a perspective and partially exploded view showing the connection of an HDMI plug into the adapter and connector illustrated in FIG. 13.

Still further, FIG. 15 illustrates a perspective view of a headphone adapter/connector assembly 218. The assembly 218 includes an adapter 220 and a connector 222. In addition, FIG. 16 illustrates a perspective view of an optical video adapter/connector assembly 236. The adapter/connector assembly 236 includes an optical video adapter 238 and an optical video connector 240. FIG. 19 is a perspective and partially exploded view showing the headphone adapter/connector assembly 218 (previously described with respect to FIG. 15), as it would be positioned for reception of a headphone plug 242. Correspondingly, FIG. 20 is a perspective and partially exploded view, illustrating the HDMI adapter/connector assembly 206 (previously described and illustrated in FIG. 13), as it is relatively positioned for receipt of an HDMI plug 244.

Figure 21:
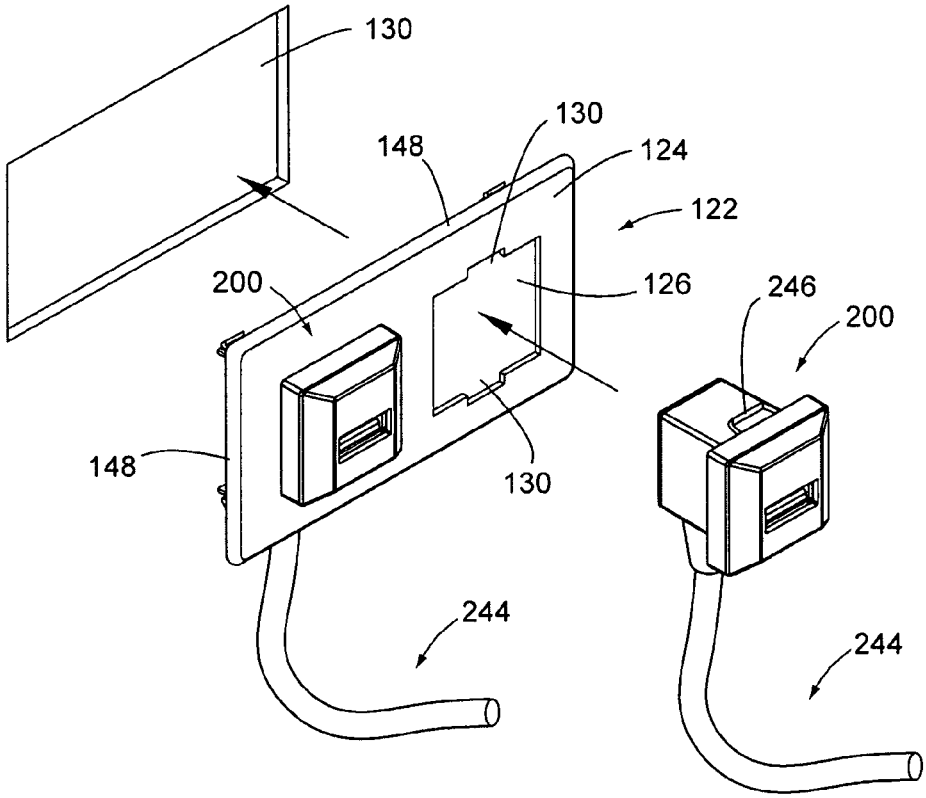
FIG. 21 is a perspective and exploded view of the assembly of one of the adapters and connectors, and further showing a base plate mountable into a surface opening.

Still further, FIG. 21 illustrates a pair of USB assemblies 200, with USB cables 244 received therein. One of the USB assemblies 200 is shown as being received within an opening 126 of a base plate 122. The base plate 122, as with the base plate 122 shown in FIG. 2, has a rectangular configuration with a front surface 124. Extending through the front surface 124 are a pair of plate openings 126. Also shown in FIG. 21 is a wall, floor or other surface opening 130. Although not shown in FIG. 21, the opening 130 may include various communication cables and wires, for voice, data or other computer and communication purposes. The cable or wiring (not shown) may be adapted to communicably connect to the couplers and jacks previously described herein.

FIG. 21 also shows the relative positioning of the USB assembly 200 as it would be inserted into one of the openings 126 of the base plate 122. The USB assembly 200 also includes resilient brackets 246 (only one of which is shown in FIG. 21) which are adapted to be releaseably received within notches 130 in the opening 126 of the base plate 122. In this manner, the USB assembly 200 can be appropriately secured to the base plate 122.

It will be apparent to those skilled in the pertinent arts that other embodiments of the invention can be designed. That is, the principles of the invention are not limited to the specific embodiments described herein. Accordingly, it will be apparent to those skilled in the art that modifications and other variations of the above-described illustrative embodiments of the invention may be effected without departing from the spirit and scope of the novel concept of the invention.

What is claimed is:

1. A voice/data adapter kit for purposes of accommodating couplers and jacks of various sizes, said kit comprising:

a base plate having one or more openings adapted to receive one or more couplers and jacks;

a plurality of voice/data adapters, with said plurality of adapters having central openings for releaseably securing couplers and jacks having variously sized outer dimensions;

a connector spline releaseably carrying said plurality of voice/data adapters, with the carrying connection of said voice/data adapters to the connector spline being one whereby any one of the voice/data adapters may be disconnected from said connecting spline by manually exerted relatively small forces on a selected voice/data adapter; and said kit further comprises at least one wedge, for purposes of securing a coupler and jack to at least to at least one of said plurality of said voice/data adapters.

2. A voice/data adapter kit in accordance with claim 1, characterized in that:

said at least one opening of said base plate is of a size and dimension so as to accommodate outer dimensions of each of said plurality of said voice/data adapters; and said base plate is adapted to be interconnected or otherwise secured to a surface opening.

3. A voice/data adapter kit in accordance with claim 1, characterized in that said connecting spline comprises:

a central post having an elongated configuration; and a plurality of cross bars, each of said cross bars integral with or otherwise connected to said central post at various longitudinal locations along said central post.

4. A voice/data adapter kit in accordance with claim 1, characterized in that said plurality of said voice/data adapters comprise at least one blank.

5. A voice/data adapter kit in accordance with claim 1, characterized in that said plurality of said voice/data adapters are arranged in sizes such that said plurality comprises a plurality of equally sized pairs of said voice/data adapters.

6. A voice/data adapter kit in accordance with claim 1, characterized in that each of said voice/data adapters is adapted to receive an appropriately sized coupler and jack in a snap fit configuration.

7. A voice/data adapter kit in accordance with claim 1, characterized in that an interconnected voice/data adapter and a coupler and jack are adapted to be snap fitted into said at least one opening of said base plate.

8. A voice/data adapter kit in accordance with claim 1, characterized in that an interconnected voice/data adapter, coupler and jack and base plate are adapted to be snap fitted into a surface opening.

9. A voice/data adapter kit, characterized in that said voice/data adapters comprise two blanks.

10. A voice/data adapter kit in accordance wit claim 1, characterized in that said voice/data adapters comprise four pairs of differently sized adapters, and a pair of blanks.

11. A voice/data adapter kit in accordance with claim 1, characterized in that said voice/data adapters comprise at least one USB adapter.

12. A voice/data adapter kit in accordance with claim 1, characterized in that said voice/data adapters comprise at least one HDMI adapter.

13. A voice/data adapter kit in accordance with claim 1, characterized in that said voice/data adapters comprise at least one headphone adapter.

14. A voice/data adapter kit in accordance with claim 1, characterized in that said voice/data adapters comprise at least one optical connecter adapter.

15. A voice/data adapter kit in accordance with claim 1, characterized in that said voice/data adapters comprise at least one pin connecter adapter.

16. A voice/data adapter kit in accordance with claim 1, characterized in that said voice/data adapters comprise at least one S-video adapter.

* * * * *

UNITED STATES PATENT AND TRADEMARK OFFICE

CERTIFICATE OF CORRECTION

PATENT NO. : 7,559,795 B2
APPLICATION NO. : 11/760921
DATED : July 14, 2009
INVENTOR(S) : Norman R. Byrne It is certified that error appears in the above-identified patent and that said Letters Patent is hereby corrected as shown below:

Column 8, line 10 "wit" should be -- with --.

Column 8, line 16 "connecter" should be -- video --.

Signed and Sealed this

Eighteenth Day of August, 2009

David J. Kappos

David J. Kappos
*Director of the United States Patent and Trademark Office*